US005923936A

United States Patent [19]

Tanoue et al.

[11] Patent Number: 5,923,936

[45] Date of Patent: Jul. 13, 1999

[54] CLEANING DEVICE FOR AN IMAGE TRANSFER BELT DEVICE

[75] Inventors: Ryou Tanoue, Yokohama; Shin-ichi Kawahara, Tokyo, both of Japan

[73] Assignee: Ricoh Company, Ltd., Tokyo, Japan

[21] Appl. No.: 09/044,795

[22] Filed: Mar. 20, 1998

[30] Foreign Application Priority Data

Mar. 27, 1997 [JP] Japan ..... AP09-093009
Apr. 3, 1997 [JP] Japan ..... AP09-085265

[51] Int. Cl.[6] ..... G03G 15/16

[52] U.S. Cl. ..... 399/297; 399/302; 399/312

[58] Field of Search ..... 399/98, 99, 101, 399/297, 298, 302, 310, 312, 123, 314, 88, 66

[56] References Cited

U.S. PATENT DOCUMENTS 5,335,052 8/1994 Sato et al. ..... 399/312
5,515,146 5/1996 Harasawa et al. ..... 399/310
5,559,590 9/1996 Arai et al. ..... 399/314

*Primary Examiner*—Arthur T. Grimley
*Assistant Examiner*—Hoan Tran
*Attorney, Agent, or Firm*—Oblon, Spivak, McClelland, Maier & Neustadt, P.C.

[57] ABSTRACT

An image forming apparatus which utilizes an intermediate transfer belt. A cleaning device is provided to remove residual toner, etc., from the intermediate transfer belt and the cleaning device includes a cleaning blade, a bias roller, and a bias roller cleaning blade. The bias roller rotates in a same direction as that of the image transfer belt. Further, the cleaning blade and the bias roller cleaning blade can be of a same length and can be mounted to a same holder. The positioning of the bias roller and the bias roller cleaning blade can be offset towards a front portion of the image forming device relative to the image transfer belt cleaning blade, to ensure that toner which deposits on a front end of the image transfer belt, even if outside of an effective image area on the image transfer belt, is removed.

28 Claims, 7 Drawing Sheets

CLEANING DEVICE FOR AN IMAGE TRANSFER BELT DEVICE

BACKGROUND OF THE INVENTION

1. Field of the Invention

This invention relates to an image transfer conveying device provided in an image forming apparatus applying an electrophotographic method, such as a copying machine, printer, facsimile, etc., and more particularly, to an image transfer conveying device implementing an electrostatic transfer utilizing a transfer belt and which removes residual toner from the transfer belt.

2. Discussion of the Background

In an image forming apparatus utilizing an electrophotographic method such as a copying machine, printer, facsimile, etc., after a photoconductive element is charged, an image from an original document is exposed or optically written on the photoconductive element, according to image information, with a laser scanning optical system or LED optical writing system, to thereby form an electrostatic latent image on the photoconductive element. The latent image is then developed with toner of a developer, and thereby a visible toner image is realized. This toner image is ultimately transferred to an image transfer member such as a paper toner sheet, etc. conveyed from a paper supplying section. The image transfer member with the image transferred thereto is then conveyed to a fixing device, and thus the toner image is fixed on the image transfer member by the fixing device to obtain a copy or print. In such an image forming apparatus, the image information formed on the photoconductive element with toner can also be intermediately transferred onto an image transfer belt prior to being transferred to the image transfer member.

FIG. 8 is a perspective view showing an example of a basic structure of a background image transfer conveying device 1. FIG. 9 is an explanatory view showing a main construction of the image forming apparatus having the image transfer conveying device as shown in FIG. 8. The image transfer conveying device 1 in FIG. 8 supports a detachable belt unit 2 on a main body 1A. The belt unit 2 includes an image transfer belt 6 movably positioned around a pair of rollers 4 and 5 for receiving a developed image from a photoconductive element 3 having a drum-shape. A DC solenoid 8 connects (contacts) and disconnects (separates) the image transfer belt 6 to and from the photoconductive element 3 via a connecting and disconnecting lever 9. An image transfer bias roller 11 applies an image transfer bias to the image transfer belt 6, and a contacting plate 13 discharges the image transfer belt 6 as illustrated in FIG. 9.

Also, a cleaning device 16 having a cleaning blade 16A removes residual toner and wipes off paper powder (from an image transfer sheet S, see FIG. 10) which adheres to a surface of the image transfer belt 6. A high voltage power source 12 applies a voltage to the image transfer bias roller 11 and is provided in the main body 1A in FIG. 8. As also shown in FIG. 8, a drive roller 5 has a gear 5*b* connected to a drive motor (not shown), and drive roller 5 is rotation driven. The image transfer belt 6 can be moved in a direction of conveying the image transfer sheet S (in a direction indicated by an arrow A in FIG. 9) at a position facing the photoconductive element 3, following the rotating direction of the drive roller 5.

As shown in FIG. 11, the image transfer belt 6 has a two-layered 6*a*, 6*b* structure, and as for its electric resistance measured according to JISK 6911 at the time of applying DC 100 V, the surface resistivity on the belt surface of the surface layer 6*b* can be set to be $1\times10^{9}$~$1\times10^{12}$, the surface resistivity rate of an inside layer 6*a* can be set to be $1\times10^{7}$~$1\times10^{9}$, and the volume resistivity can be set to be $5\times10^{8}$ cm~$5\times10^{10}$ cm.

As shown in FIGS. 8 and 9, the pair of rollers 4 and 5 are supported by a supporter 7 to rotate freely. The supporter 7 can move by making a fulcrum of the supporting axis 5*a* of the roller 5 positioned downstream of an image transfer position against the photoconductive element 3 in an advancing direction of image transfer paper S indicated with the arrow A, out of rollers 4 and 5. This supporter 7 is operated by the DC solenoid 8 which is driven by a signal from a control panel 8A on an image transfer position side. That is, the DC solenoid 8 is linked with the connecting and disconnecting lever 9, which makes the supporter 7 move, enabling the image transfer belt 6 to contact or separate from the photoconductive element 3. FIG. 9 shows a state of the image transfer belt 6 separated from the photoconductive element 3, and FIG. 10 shows a state of the image transfer belt 6 contacting the photoconductive element 3.

When a tip end of the image transfer sheet S is aligned with a leading edge of the image formed on the photoconductive element 3 by the registration roller pair 10, the control panel 8A drives the DC solenoid 8 with a drive signal. Accordingly, as shown in FIG. 10, by driving this DC solenoid 8, the supporter 7 approaches the photoconductive element 3, and by contacting the image transfer belt 6 to the photoconductive element 3, a nip section B is formed so that the image transfer sheet S contacts the photoconductive element 3 at a position opposite the photoconductive element 3. The roller 4 operates as a follower roller to follow drive roller 5, and the surface of roller 4 can be in a shape of a taper with both sides of the drive roller 5 in an axis direction having sharp tips, which prevents deviation of image transfer belt 6. The roller 4 is a conductive roller made of conductive metal, etc., but only supports the image transfer belt 6 having an electric-resistance as mentioned above, and is not directly connected to any other conductive members electrically.

Also, the materials for the drive roller 5 can be selected from EPD rubber, chloroprene rubber, or silicone rubber to enhance the power of gripping the image transfer belt 6 at the time of driving.

The image transfer bias roller 11 is connected to an inside of the image transfer belt 6 downstream of the following roller 4 in a moving direction of the image transfer belt 6. This image transfer bias roller 11 constitutes a connecting electrode for providing an electric charge with a polarity inverse to a polarity of the toner on the photoconductive element 3 against the image transfer belt 6, and is connected to the high voltage power source 12.

The contacting plate 13 can be provided on an inside face of the image transfer belt 6 near the following roller 4 at a side below where the image transfer sheet S contacts the image transfer belt 6, contacting plate 13 prevents a charge on the image transfer sheet S upstream of the image transfer nip section B. Also, this contacting plate 13 can detect current flowing on the image transfer belt 6 as a feedback current, and this current detection can control the current supplied from the image transfer bias roller 11. Therefore, the contacting plate 13 is connected to an image transfer control panel 14 to set up the current to be supplied to the image transfer bias roller 11 according to the detected current, and this image transfer control panel 14 is connected to the high voltage power source 12. A location at which the contacting plate 13 is provided is not limited to the inner face of the image transfer belt 6 near the following roller 4, and the contacting plate 13 may also be provided at an inner face of the image transfer belt 6 near the drive roller 5 or at other positions.

As shown in FIG. 10, for such an image transfer conveying device 1, the states and positions of the parts are set up so that the supporter 7 moves the image transfer belt 6 to approach the photoconductive element 3, in conformance to the image transfer sheet S being sent out from registration rollers pair 10. Further, the nip section B, which may have a width of 4 mm to 8 mm corresponding to a length along the conveying direction of the image transfer sheet S, is formed between the image transfer belt 6 and the photoconductive element 3.

FIG. 12 shows image transfer in the device of FIGS. 8–11. When the surface of photoconductive element 3 is in a state of charging at, for example, −800 V as shown in FIG. 12, positively charged toner electrostatically adhered on the surface of the photoconductive element 3 is moved to the nip section B (see FIG. 10). At the time that a part of the photoconductive element 3 is positioned near the image transfer belt 6 before coming to the nip section B, the surface potential of the photoconductive element 3 is lowered by a pre-transfer discharge lamp 15 (PTL 15) positioned adjacent the photoconductive element 3 which weakens the charge on the surface of photoconductive element 3. FIG. 12 shows the degree of charge according to a size of the circle marks, and a state of a toner charge after lowering by PTL 15 is shown as smaller circles compared to the size of the larger circle marks indicating a charge before discharge.

In the nip section B, the toner on the photoconductive element 3 is transferred to the image transfer sheet S by the image transfer bias from the image transfer bias roller 11 positioned (or located) at an opposite side (or inside) of the image transfer belt 6. This image transfer bias is applied from the high voltage power source 12 in the range of −1.5 k V to 6.5 k V, but as a result of the below-mentioned constant-current control operation, the image transfer bias is variably set up. That is, in FIGS. 9 and 10, when the current value output from the high voltage power source 12 is I and a value in a case of detecting a value of feedback current flowing from the contacting plate 13 via the image transfer belt 6 is 12, the value of II is controlled so that the following relation can be acquired between both the values:

$$I1-I2=I\ OUT(\text{but, } I\ OUT\text{: constant}) \quad (1)$$

This eliminates variation in the efficiency of image transfer by stabilizing the surface potential Vp on the image transfer sheet S regardless of changes in temperature, humidity, other surrounding conditions, unevenness arising from a manufactured quality of image transfer belt 6, etc.

In other words, by deeming the above as the current I OUT flowing to the photoconductive element 3 via the image transfer belt 6 and the image transfer sheet S, the flowing ability of current to the image transfer belt 6 can vary in consequence of, e.g., resistance lowering or heightening of a surface resistance Vp on the image transfer sheet S, to thereby prevent any adverse influence on the separating ability and image transferring performance of the image transfer sheet S.

In this example, in a case of a conveying velocity of 330 mm/sec, an effective image transfer bias roller length of 310 mm, I OUT=35 A−5 A, such that I OUT can obtain a good image transfer.

Further, image transfer is conducted from the photoconductive element 3, and the image transfer sheet S is also charged simultaneously. Accordingly, due to a relation of a true electric charge of the image transfer belt 6 to a polarization charge generated at image transfer sheet S, the image transfer sheet S is electrostatically attracted to the image transfer belt 6, to enable the image transfer sheet S to separate from the photoconductive element 3. Also, a peeling-off operation by a stiffness of the image transfer sheet S utilizing the curvature separation of the photoconductive element 3 enables the above separation.

However, such an electrostatic attraction gives rise to a possibility that the image transfer sheet S will not be separated smoothly from the image transfer belt 6, depending on a variation of surrounding conditions, particularly in a case of high humidity which causes current to flow to the image transfer sheet S. Therefore, setting up a somewhat higher resistance value on the surface layer **6*b* of the image transfer belt 6 allows a delayed transition of a true charge on the image transfer sheet S in the nip section B. Thereby, a transition of the true electric charge from the image transfer belt 6 to the image transfer sheet S can be delayed, which prevents electrostatic attraction relations between the image transfer sheet S and photoconductive element 3**.

The delayed transition of true electric charge in this case means that no charge is generated on the image transfer sheet S upstream to until the image transfer sheet S extends to the nip section B on the side of photoconductive element 3. Thereby, winding of the image transfer sheet S into the photoconductive element 3 is prevented, and also faulty separating of the image transfer sheet S from the photoconductive element 3 is prevented.

Further, materials with an invariable resistance depending on a change of surrounding conditions may be favorably selected as materials for the image transfer belt 6. As conductive materials to control resistance, when adding a proper volume of carbon, zinc oxide and the like, and when using a rubber belt as an elastic belt, materials with less hygoscopicity and stabilized resistance value such as chloroprene rubber, EPD rubber, silicone rubber, epichlorohydrin rubber may be desirably selected.

Moreover, the value of current I OUT flowing to the photoconductive element 3 can be reduced in a case of a low conveying speed, and inversely such a value can be increased when the conveying speed is high or the PTL 15 is not used.

Whereas the image transfer sheet S passing the nip section B is electrostatically attracted to and carried in conformity to the movement of the image transfer belt 6, curvature separation occurs from the drive roller 5. Thereby, the diameter of drive roller 5 can be set not to exceed 16 mm. Further, when using such a drive roller 5, experiments have shown that to achieve such a separating effect high quality 45 K paper (rigidity: horizontal 21 [$cm^3$/100]) can preferably be utilized.

Also, as shown in FIG. 9, the image transfer sheet S separated from the image transfer belt 6 with the drive roller 5 is then carried between a heating roller **17*a* included in fixing section 17, by being guided by a guide plate, and a pad roller 17*b*. The fixing section 17** fixes the toner image onto the image transfer sheet S by heating and melting the toner on the image transfer sheet S and by contacting and pressing the toner image onto the image transfer sheet S.

When the image transfer belt 6 completes the image transfer and is separated from the image transfer sheet S, supporter 7 supporting the image transfer belt 6 is separated from the photoconductive element 3, by releasing the connecting and disconnecting lever 9 according to a releasing excitation of DC solenoid 8. The surface of the image transfer belt 6 is then cleaned by cleaning device 16. The cleaning device 16 includes cleaning blade 16A, which peels off toner or paper powder of the image transfer sheet S from the image transfer belt 6.

The image transfer belt 6 is frictionally contacted by the cleaning blade 16A. The image transfer belt 6 may be covered by fluorine contained resin on its surface to lower a friction coefficient, or for example, polyvinylidene fluoride, tetrafluoroethylene and the like, to prevent enlarging a required driving power due to any increased sliding and friction resistance. Also, the toner or paper powder removed from the surface of the image transfer belt 6 can be stored into a waste toner recovery container (not shown) from the main body 1 by the toner recovery coil 16B.

In this structure of the image transfer conveying device using the image transfer belt 6, the device for cleaning the image transfer belt may include the cleaning blade 16A only (as in FIGS. 8–10), and a width of a cleaning area of cleaning blade 16A is about 10 mm broader than both ends of an effective image area on the image transfer belt 6.

However, one drawback in the above-discussed background device is that toner on the image transfer belt 6 actually exists not only just outside the effective image forming area, but also to the edges of the image transfer belt 6 due to splashing of toner, i.e. toner splashes onto the image transfer belt 6 outside of 10 mm beyond the effective image forming area. Also, when cleaning the toner on the edges of the image transfer belt 6 by using the cleaning blade 16A, the edges of the cleaning blade 16A may entangle at the edge sections. Therefore, the length of the cleaning blade 16A is made shorter than the width of the image transfer belt 6, and toner at the edge sections of the image transfer belt 6 can not be cleaned by the cleaning blade 16A, but may remain on the edges of the image transfer belt 6. When toner is attached to edge sections of the image transfer belt 6 on a front side of the image forming device, i.e. a side to which a door of the image forming device may open in servicing the image forming device, for example to address a paperjamming, there may arise a problem of an operator's hand getting dirty from such remaining toner in a case of the operator inserting a hand into the belt section for treatment of the paper jamming and the like.

Also with the device as shown in FIGS. 8–11, paper powder of a transfer sheet may adhere onto a tip end edge of the cleaning blade 16A, and the cleaning blade 16A may then be in a state of separating from and not properly contacting the image transfer belt 6. As a result, residual toner slips down through a gap between the cleaning blade 16A and the image transfer belt 6, allowing dirt to fall on a back face of a transfer paper sheet S or to slip down past the cleaning blade 16A to fix onto the image transfer belt 6.

To solve such a problem, an applicant of this patent application has proposed a construction of a cleaning device as illustrated in FIG. 13.

FIG. 13 shows the image transfer belt 6, the drive roller 5, and a cleaning device 24 on the whole, having cleaning blade 16A as a main cleaning device for the cleaning device 24, and cleaning member 28 as a subsidiary cleaning device for the cleaning device 24. The cleaning member 28 includes a bias roller 28A, which applies an electric field with an inverse polarity to a polarity of an applied electric field of the bias roller 11 providing the electric charge to the image transfer belt 6, and a blade 28*b* to remove toner adhering to the surface of the bias roller 28*a*. Further, the bias roller 28*a* rotates in a reverse direction to the advancing direction of the image transfer belt 6.

Such a cleaning device has advantages in a case that paper powder and the like of a transfer paper sheet S adheres to a tip portion of an edge of cleaning blade 16A and residual toner slips down past the cleaning blade 16A, specifically that the slipping toner will adhere to the bias roller 28*a* rotating in the reverse direction against the advancing direction of the image transfer belt 6 downstream of rotation of the image transfer belt 6, which enables residual toner to be wiped off and which prevents dirt from reaching a back face of the transfer sheet S and an end face of an edge of the cleaning blade 16A.

However, this structure still does not adequately remove toner from edges of image transfer belt 6. Further the bias roller 28*a* and the image transfer belt 6 are attracted to each other by an electrostatic force, since the cleaning device applies a bias voltage by the bias roller 28*a*. Further, the bias roller 28*a* rotates in opposition to the rotation direction of the image transfer belt 6. Therefore, a problem occurs that a noise arises by the rubbing together of the bias roller 28*a* and the image transfer belt 6, which noise particularly arises from bias roller 28*a* rotating in an opposite direction to image transfer belt 6. Further, the surface coating of image transfer belt 6 is excessively scraped, and as a result cleaning efficiency decreases, and scraping the surface coating causes a friction coefficient on the image transfer belt 6 surface to increase, which results in entangling make global change of the cleaning blade 16A as a main cleaning device, when the bias roller 28*a* rotates in the reverse direction against the advancing direction of the image transfer belt 6. Further, as the bias roller 28*a* rotates against the advancing direction of the image transfer belt 6, the image transfer belt 6 may slacken around its contact point with the bias roller 28*a*. These drawbacks are particularly significant if the image transfer belt 6 is made of material like rubber, etc., as opposed to being made of a slippery resin.

SUMMARY OF THE INVENTION

Accordingly, it is an object of the present invention to solve the above-mentioned problems in the background art.

It is a more specific object of the present invention to provide a novel cleaning device for an image forming apparatus utilizing an intermediate transfer belt in which cleaning efficiency is improved.

A further more specific object of the present invention is to provide a novel cleaning device for an image forming apparatus utilizing an intermediate transfer belt in which a frictional coefficient of the transfer belt can be maintained by not excessively scraping a surface coating of the transfer belt, and which can avoid entangling of a cleaning blade around the intermediate transfer belt.

It is a further object of the present invention to provide an image transfer conveying device having a device for cleaning toner on end sections of an image transfer belt, to thereby prevent dirt from reaching an operator's hand due to toner depositing on at least a front end section of the image transfer belt.

It is another object of the present invention to lower a cost for a device for cleaning an image transfer belt, to save space, and to reduce a number of replacement parts.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
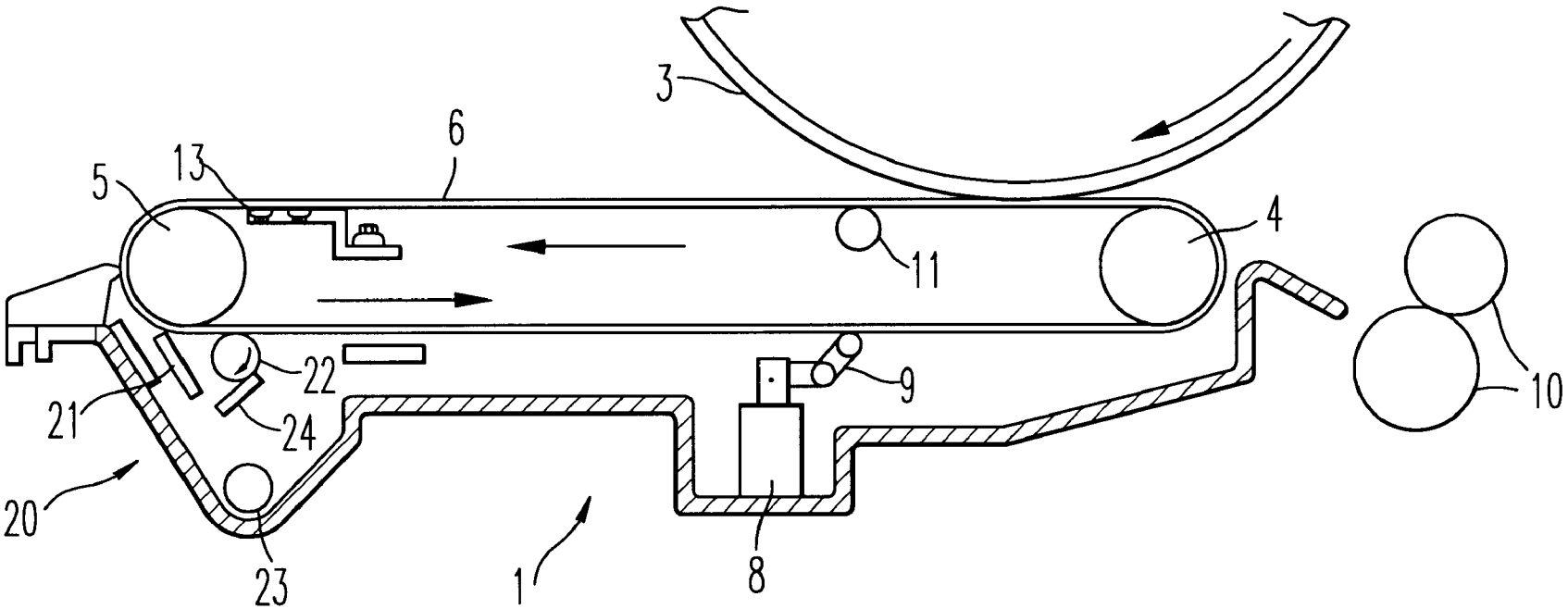
FIG. 1 shows a schematic construction of an image forming apparatus utilizing an image transfer belt device according to the present invention.

Preferred embodiments according to the present invention are described below, in which like reference numerals indicate identical or corresponding parts throughout the several views.

Figure 2:
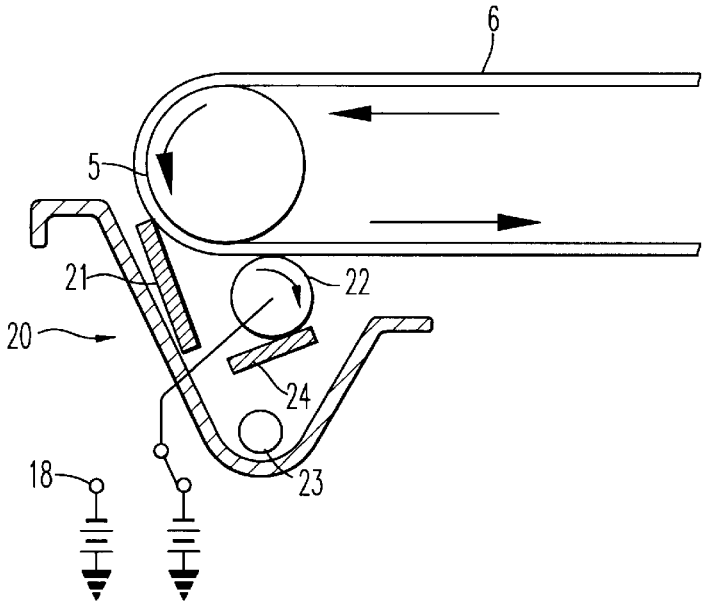
FIG. 2 is a partly enlarged view showing a cleaning device of the device of FIG. 1 according to the invention.

FIG. 1 is a schematic structural view showing a preferred embodiment according to the present invention, and FIG. 2 is a partially enlarged view showing a main section of an image transfer belt cleaning device of the image transfer conveying device of FIG. 1. The basic structure of the image transfer conveying device according to the present invention has a similar structure to the device as illustrated in FIGS. 8 through FIG. 13 except for the image transfer belt cleaning device 20, and thereby a redundant description of similar elements and operations is not provided.

As shown in FIGS. 1 and 2, a cleaning device 20 of the present invention for cleaning a surface of an image transfer belt 6 includes a cleaning blade 21 composed of polyurethane as a main cleaning member, which removes residual toner and paper powder attached to the image transfer belt 6. Further, a bias roller 22 operates as a cleaning member providing an electric field as a subsidiary cleaning device, which electrostatically removes toner, etc. slipping past the cleaning blade 21. Further, a specified voltage is applied to the bias roller 22 by a cleaning bias power source 18. Also, toner, etc. attracted to the bias roller 22 is removed by a cleaning blade 24 for the bias roller 22. And the toner, etc. removed from the surface of the image transfer belt 6 or the bias roller 22 are carried to and stored into a waste recovery container (not shown) by a toner collecting coil 23 provided at a lower section of the cleaning device 20.

The bias roller 22 of the subsidiary cleaning system may, for example, be linked to a drive roller 5 of the image transfer belt 6 via gears, etc., which causes the drive roller 5 and bias roller 22 to rotate connectively. As one feature of the present invention, the bias roller 22 rotates in an inverse direction to the rotational direction of the drive roller 5 of the image transfer belt 6, but in the same direction of rotation as the image transfer belt 6. The velocity of rotating the bias roller 22 (i.e., a circumferential speed of an outer peripheral speed of the bias roller 22) can be the same as the rotating speed (circumferential speed) of the image transfer belt 6 according to the gear rate, etc.

As noted above, in this embodiment of the present invention of FIG. 1 the bias roller 22 rotates in a same direction as that of the image transfer belt 6. As a consequence of this operation of the present invention, noise resulting out of a vibration from the rotation of the bias roller 22 opposite to that of the image transfer belt 6 can be reduced, and any excessive scraping of the image transfer belt 6 from the bias roller 22 or slackening of the image transfer belt 6 can also be prevented.

FIG. 2 is a partially enlarged view showing the cleaning device 20 of FIG. 1. When a cleaning operation is performed, a positive electric field (of an inverse polarity to that of the transfer bias roller 11) is applied to the bias roller 22, and as noted above the bias roller 22 rotates in a direction reverse to the transfer belt drive roller 5, namely in a same direction as the transfer belt 6. Furthermore, as described below, when in a copying mode, a selecting switch 18 can change the polarity of an electric field applied to the bias roller 12.

Figure 3:
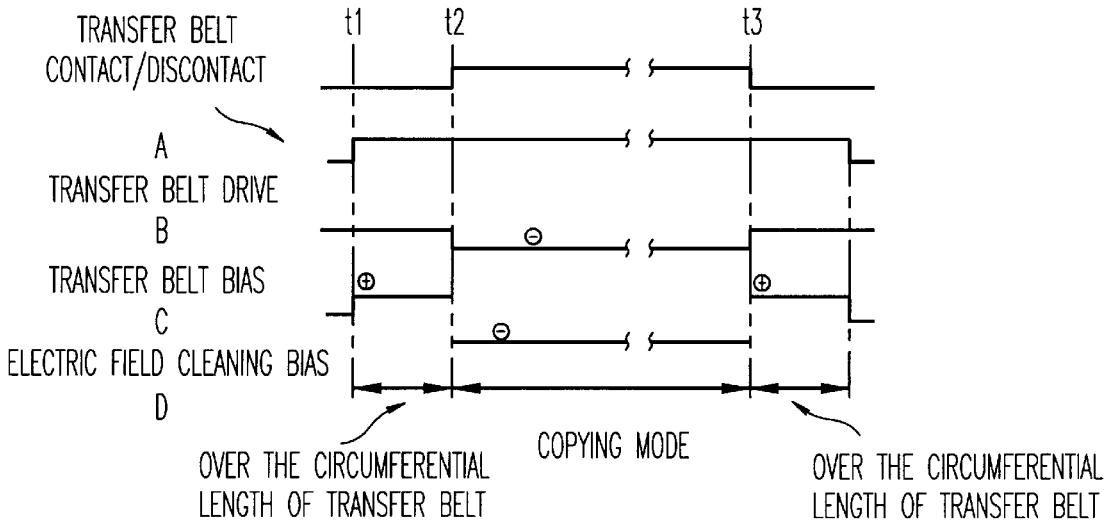
FIG. 3 is a timing chart illustrating the timing of applying an electric field to a bias roller of a cleaning device according to the present invention.

A timing of applying an electric field to the bias roller 22 is explained according to the timing chart shown in FIG. 3, which shows the following states:

(a) at a time of starting a copying mode t2, the transfer sheet S is conveyed to contact the image transfer belt 6, and this contact continues to a time t3 of terminating the copying mode;

(b) the image transfer belt 6 has already driven and been rotated at the time t1 before the copying mode is started;

(c) at the time t2, the negative electric field transfer bias is started to be applied to the transfer bias roller 11, and this is terminated at time t3;

(d) from the time t1 of the time before starting the copying mode, to the time t2, the positive electric field bias is applied to the bias roller 22.

Applying the bias to the bias roller 22 during the period from the time t1 to the time t2ensures that the bias is applied throughout an entire circumferential length of the image transfer belt 6. This bias application applies the transfer bias with a same polarity as that of an applied transfer bias to the transfer bias roller 11 and with an electric field larger than that of the transfer bias, i.e., a negative field, during the period from the time t2 to the time t3 after the copying mode has started, and the bias application continues for a time for which allows an entire circumferential length of transfer belt 6 to pass.

As the polarity of the electric field applied to the bias roller 22 is the same polarity as that applied by the transfer bias roller 11 for the transfer in a copying mode, and is an inverse polarity to that of the transfer bias roller 11 at other times than in the copying mode, and because this bias application continues for a time of passing an entire circumferential length of the transfer belt 6, any inverse charged toner adhering to the image transfer belt 6 can be completely removed. By controlling the bias application as per steps (a) through (d) mentioned above, toner slipping past the cleaning blade 21 can be removed.

Further, the rotating direction of bias roller 22 is in the same direction as the advancing direction of the image transfer belt 6, and thus noise from rubbing between the bias roller 22 and the image transfer belt 6 is deceased, peeling of a surface coating on a surface of the image transfer belt 6 is prevented, a cleaning efficiency is improved, an entangling of the cleaning blade 16A into the image transfer belt 6 and a slackening of the image transfer belt 6 can be prevented.

Furthermore, in the aforementioned description, by selectively operating selecting switch 18, the electric field to be applied to the bias roller 22 can be charged. However, any other device can be used to change the polarity of the electric field applied to the bias roller 22.

Figure 4:
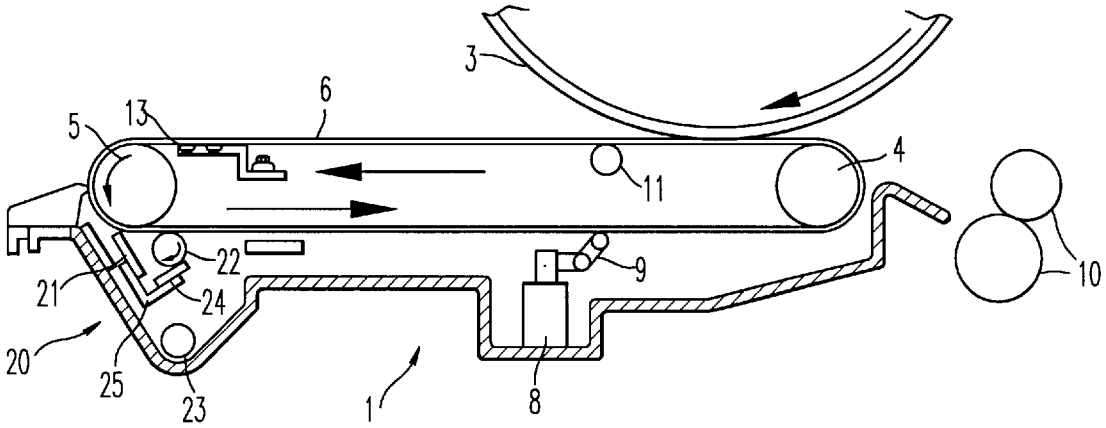
FIG. 4 is a schematic structural view of an image transfer conveying device showing a further feature of the present invention.
Figure 5:
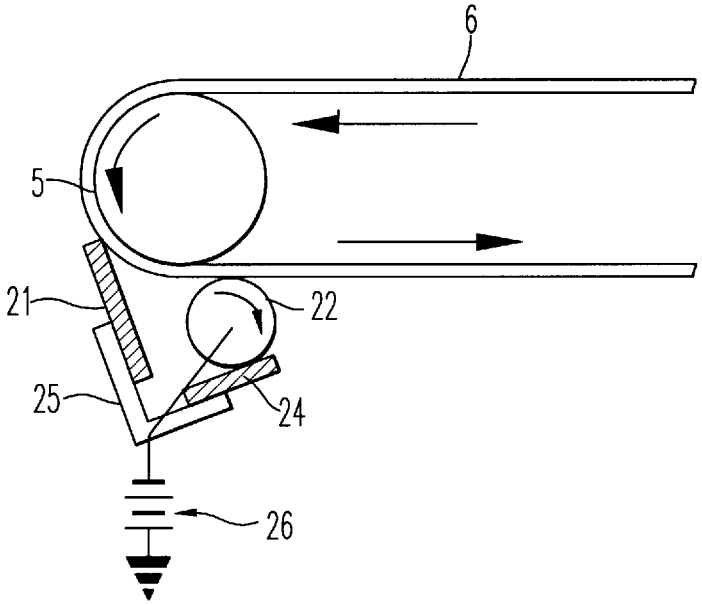
FIG. 5 is an enlarged view showing a main section of an image transfer belt cleaning device of the image transfer conveying device of FIG. 4 of the present invention.
Figure 6:
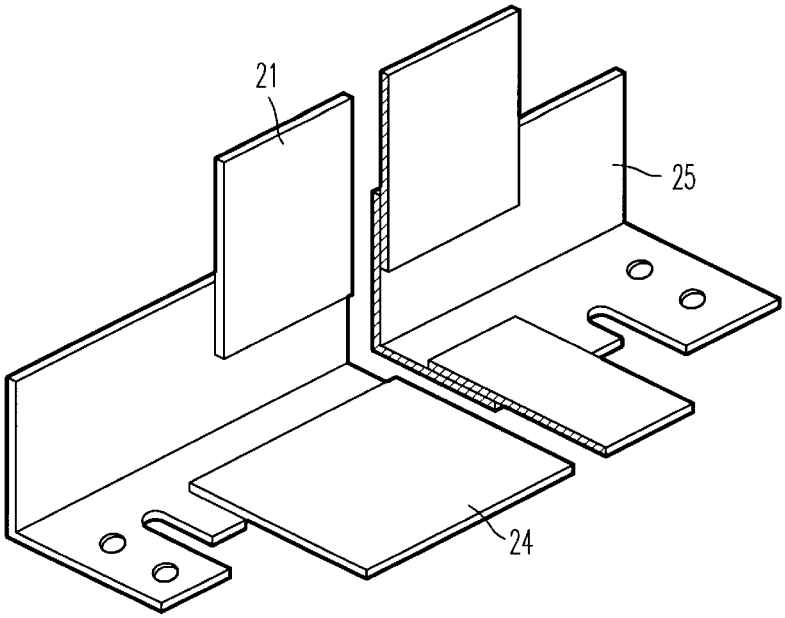
FIG. 6 is an enlarged view showing a cleaning blade, a bias roller cleaning blade, and a blade holder of the embodiment of FIGS. 4 and 5 of the present invention.

A further feature of the present invention is shown in FIGS. 4–6 which shows that the cleaning blade 21 and the bias roller cleaning blade 24 are supported by a single blade holder 25. That is, the cleaning blade 21 and the bias roller cleaning blade 24 are unified, for example they are attached to the same blade holder 25 composed of a sheet metal, and are then supported. As a method for biasing the cleaning blades 21, 24, springs (not shown) may be utilized. Further, to avoid utilizing special biasing springs, both the cleaning blades 21, 24 may not be biased by a spring, etc., but may be biased by pressing and contacting point edges of each of the cleaning blades 21 and 24 to the image transfer belt 6 and the bias roller 22, and according to the volume of interposing each of these blades to the image transfer belt 6 and the bias roller 22. By using such a biasing method, the use of springs and other parts can be saved, which results in a cost saving.

Since the image transfer conveying device of the structure as shown in FIG. 4 and FIG. 5 includes a main cleaning system 20 with cleaning blade 21 and a subsidiary cleaning system of the bias roller 22 for the image transfer belt 6, an outside of the cleaning area of the cleaning blade 21 can be cleaned by the bias roller 22.

A further structure in the present invention is to lengthen the bias roller 22 and the cleaning blade 24 for the bias roller to be longer than the width of the cleaning blade 21, to cause the cleaning area of the bias roller 22 to be broader than that of the cleaning blade 21. This structure enables toner at edge sections of the image transfer belt 6 to be cleaned and removed with certainty. Accordingly, a problem of dirtying an operator's hand from toner at a front edge of the image transfer belt 6 at a time of a jamming, etc., processing can be solved.

That is, toner may deposit on the image transfer belt 6 throughout a width of the image transfer belt 6, i.e., outside an effective image formation area on the image transfer belt 6. Toner may then deposit at an edge of the image transfer belt 6 towards a front of the image forming device, for example towards a front end which can be accessed if a paper jam occurs in the image forming device, etc. Then, as an operator addresses the paper jam, the operator will open the image forming device and may contact the front end of the image transfer belt 6, and thereby the operator's hands may become dirty from toner deposited on this front end of the image transfer belt 6.

Therefore, a further feature of the present invention is to remove toner on the image transfer belt 6 towards this front end of the image transfer belt 6, even though such remaining toner is outside of an effective image formation area on the image transfer belt 6. The present invention achieves this object by controlling the lengths and the positioning of the cleaning blades 21, 24 and the positioning and length of the bias roller 22 as discussed below.

As mentioned above, when lengthening the bias roller 22 and the cleaning blade 24 for the bias roller, toner on both edges of the image transfer belt 6 can be surely cleaned, but because the length of cleaning blade 21 is then different from that of the bias roller cleaning blade 24, two kinds of blades must be manufactured, resulting in an increase in cost. Also, there remains a problem of toner depositing to the edge section of the image transfer belt 6, particularly at a rear side of the device, although at least the toner attached to a front end section of an image transfer belt 6 at a front side of the device may be cleaned.

Thereby, as another embodiment of a structure according to the present invention, for a structure of an image transfer conveying device as shown in FIG. 4 and FIG. 5, the length of the cleaning blade 21 can be made to be the same as that of the cleaning blade 24 for the bias roller, and further a position that one blade is fixed can be different from that for the other blade. More particularly, the cleaning blade 24 for the bias roller can be provided at a position somewhat displaced to a front side relative to a position where the cleaning blade 21 is provided. Such an embodiment is now described below.

Figure 7:
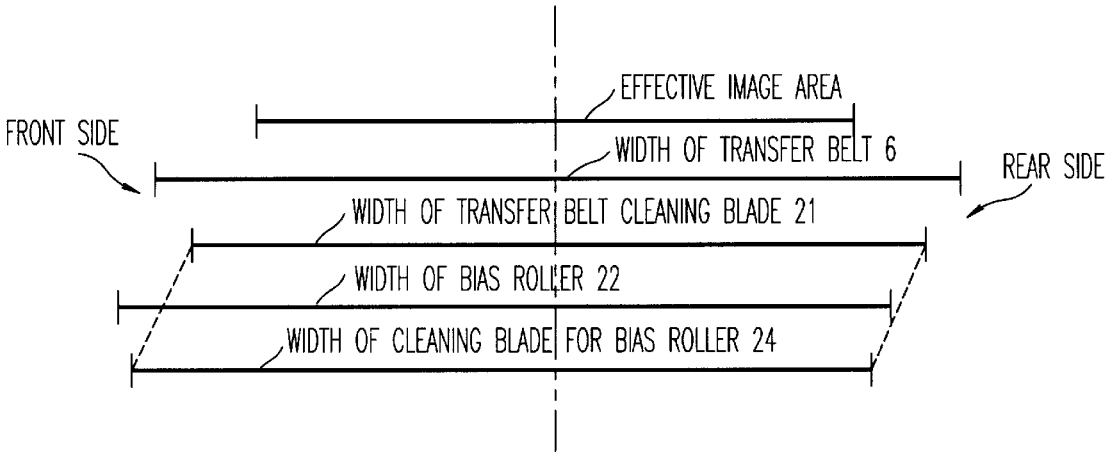
FIG. 7 is a diagram showing a breadth of an image transfer belt, and a length of a cleaning area of a cleaning blade, bias roller and bias roller cleaning blade in an embodiment of the present invention.
Figure 8:
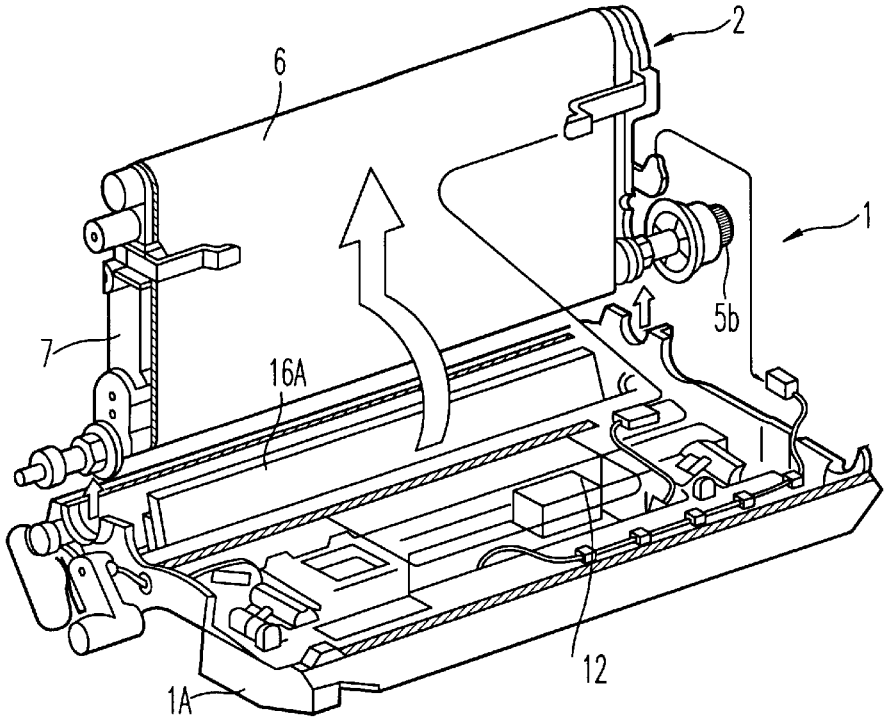
FIG. 8 BACKGROUND ART
FIG. 8 is a perspective view showing an embodiment of a basic structure of an image transfer conveying device.
Figure 9:
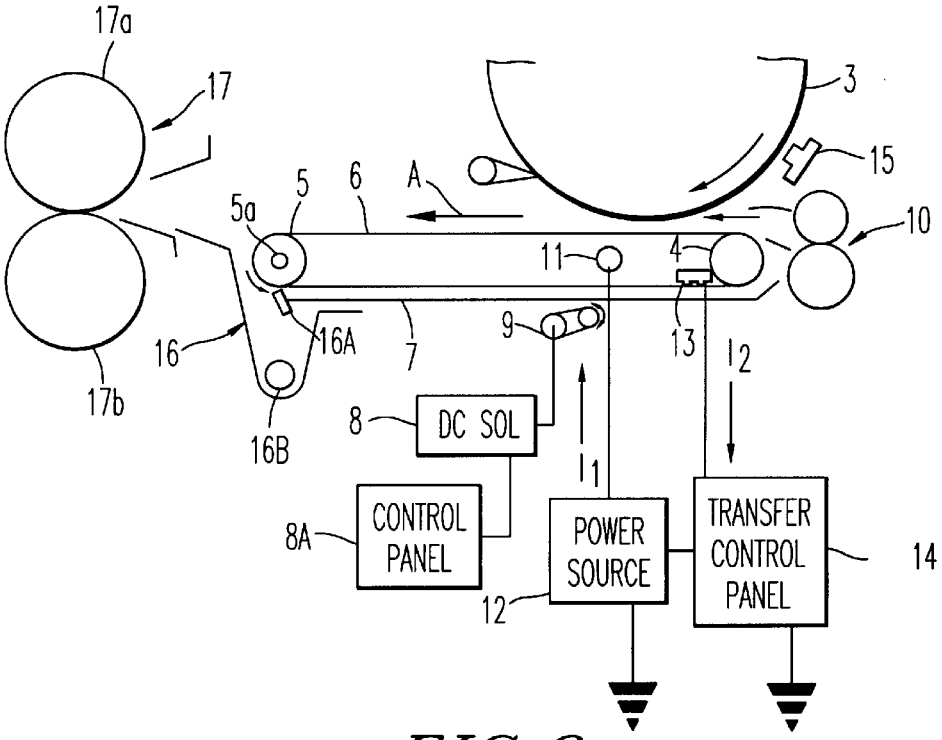
FIG. 9 BACKGROUND ART
FIG. 9 is a descriptive view showing a main structure of an image forming apparatus having the image transfer conveying device as shown in FIG. 8.
Figure 10:
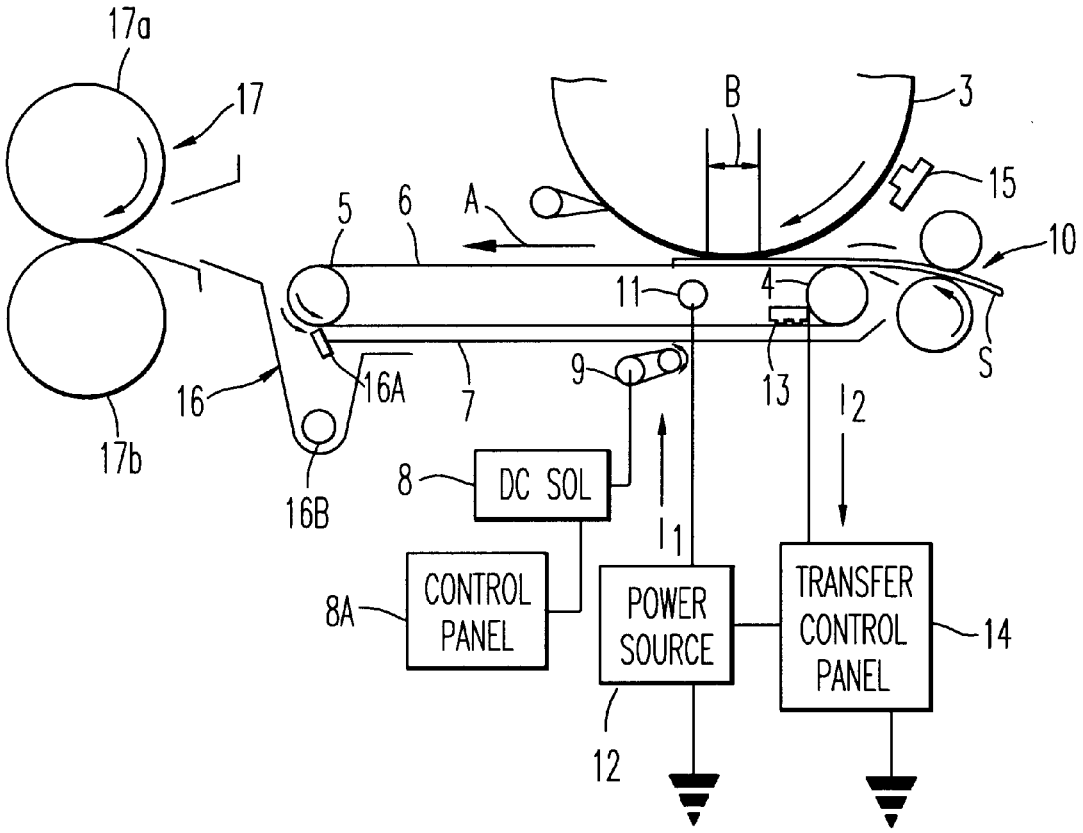
FIG. 10 BACKGROUND ART
FIG. 10 is a descriptive view showing a state at a time of a transfer for the image forming apparatus shown in FIG. 9.
Figure 11:
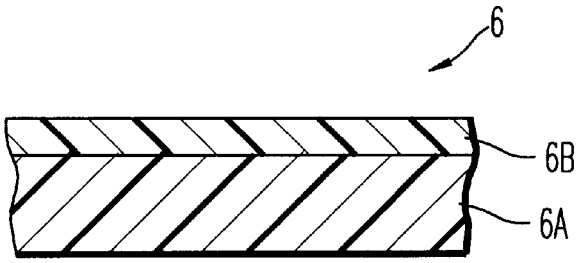
FIG. 11 BACKGROUND ART
FIG. 11 is a partially sectional view showing an image transfer belt of a two-layered structure.
Figure 12:
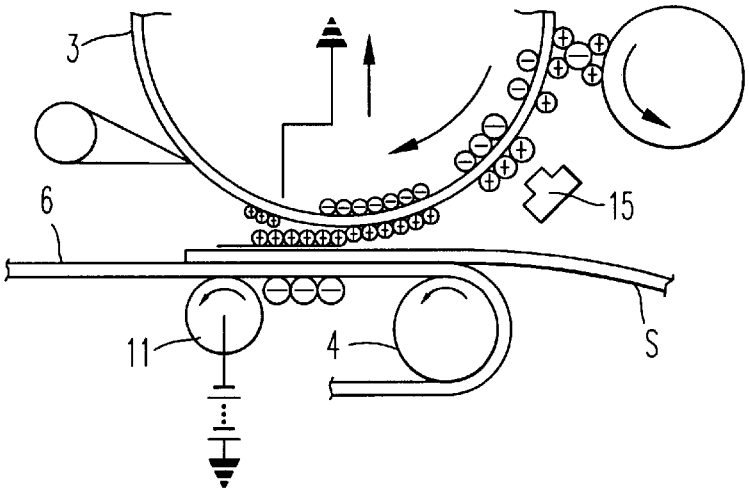
FIG. 12 BACKGROUND ART
FIG. 12 is a descriptive view showing the developing and image transfer processing for the image forming apparatus as shown in FIGS. 9 and 10.
Figure 13:
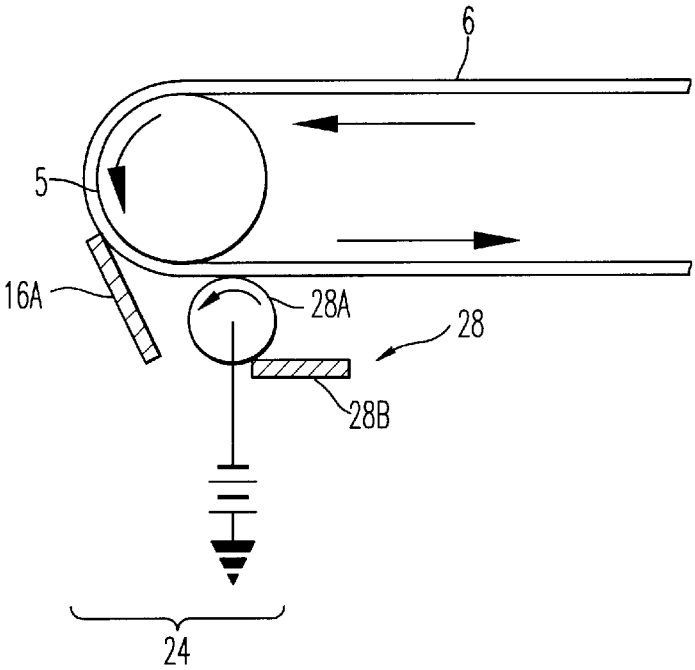
FIG. 13 BACKGROUND ART
FIG. 13 is an illustration of a schematic construction of an intermediate transfer belt cleaning device.

FIG. 6 is an enlarged view showing the cleaning blade 21 and the bias roller cleaning blade 24 with the blade holder 25. FIG. 7 is a diagram indicating the cleaning area and length for each of the cleaning blade 21, bias roller 22 and bias roller cleaning blade 24 corresponding to the image transfer belt 6 width and an effective image area.

In FIG. 6, the cleaning blade 21 and the bias roller cleaning blade 24 are attached to a plate holder 25 composed of a plate metal. The cleaning blade 21 and the bias roller cleaning blade 24 are the same in all board thickness, material quality, length, etc., but attaching positions to the blade holder 25 are different from one another. That is, the bias roller cleaning blade 24 is attached at a position somewhat displaced to a front side of the device while the cleaning blade 21 is attached to the blade holder 25 without such a displacement. And, as shown in FIG. 7, the bias roller 22 is also provided at a position somewhat displaced to the front side of the device.

As a result, an outside of the cleaning area of cleaning blade 21 on the front side of the device can be cleaned, and the front end section of the image transfer belt 6 can also be cleaned by the bias roller 22. Moreover, toner attached to the bias roller 22 can be removed by the cleaning blade 24 for the bias roller. Therefore, toner attached to a front end section of the image transfer belt 6 on the front side of the device can surely be removed, which solves a problem of dirtying an operator's hand due to toner attached to the front end section of the image transfer belt 6 at the time of addressing a paper jamming, etc. Also, the same blade holder 25 can be used for the cleaning blade 21 and the bias roller cleaning blade 24 to simplify construction. Furthermore, both the blades 21, 24 are attached to the same blade holder 25 and are integrated, resulting in a cost saving, space saving, and reducing replacement parts.

In the structure of this embodiment according to the present invention, residual toner may remain attached to a rear end section of the image transfer belt 6 at a rear side of device, but this rear end section of the image transfer belt 6 at the rear side of the device is outside an effective image area, and is also outside a carriage area of image transfer paper, and thus no operator's hand inserted into the belt to correct a jamming process, etc., reaches such a rear end. Thus this toner remaining at the rear side of the image transfer belt 6 does not cause any problem.

Obviously, numerous modifications and variations of the present invention are possible in light of the above teachings. It is therefore to be understood that within the scope of the appended claims, the invention may be practiced otherwise than as specifically described herein.

The present invention is based on Japanese priority documents, JP 9-085265 and JP 9093009, the contents of which are incorporated herein by reference.

What is claimed as new and desired to be secured by Letters Patent of the United States is:

1. A transfer system, comprising:

a transfer member;

a first cleaning blade which contacts the transfer member;

a bias roller which contacts the transfer member;

a motor which drives the bias roller in a same direction as the transfer member is moving at a point of contact between the transfer member and the bias roller;

a power source which applies a bias voltage to the bias roller; and a second cleaning blade which contacts the bias roller.

2. The transfer system according to claim 1, wherein the first cleaning blade and the second cleaning blade are mounted to a common holder.

3. The transfer system according to claim 1, wherein a length of the first cleaning blade is less than a width of the transfer belt.

4. The transfer system according to claim 1, wherein a length of the bias roller is greater than a length of the first cleaning blade.

5. The transfer system according to claim 1, wherein the second cleaning blade is offset toward a front side of the transfer system relative to the first cleaning blade.

6. The transfer system according to claim 2, wherein the second cleaning blade is offset toward a front side of the transfer system relative to the first cleaning blade.

7. The transfer system according to claim 3, wherein the second cleaning blade is offset toward a front side of the transfer system relative to the first cleaning blade.

8. The transfer system according to claim 4, wherein the second cleaning blade is offset toward a front side of the transfer system relative to the first cleaning blade.

9. The transfer system according to claim 1, wherein the bias roller is offset toward a front side of the transfer system relative to the first and second cleaning blades.

10. The transfer system according to claim 2, wherein the bias roller is offset toward a front side of the transfer system relative to the first and second cleaning blades.

11. The transfer system according to claim 3, wherein the bias roller is offset toward a front side of the transfer system relative to the first and second cleaning blades.

12. The transfer system according to claim 4, wherein the bias roller is offset toward a front side of the transfer system relative to the first and second cleaning blades.

13. The transfer system according to claim 1, wherein a length of the first cleaning blade equals a length of the second cleaning blade.

14. The transfer system according to claim 1, wherein a circumferential speed of the transfer member equals a circumferential speed of the bias roller.

15. A transfer system, comprising:

an intermediate transfer means;

a first cleaning means which contacts the intermediate transfer means;

a biasing means which contacts the intermediate transfer means;

a driving means for driving the biasing means in a same direction as the intermediate transfer means is moving at a point of contact between the intermediate transfer means and the biasing means;

a means for applying a bias voltage to the biasing means; and a second cleaning means which contacts the biasing means.

16. The transfer system according to claim 15, wherein the first cleaning means and the second cleaning means are mounted to a common holder means.

17. The transfer system according to claim 15, wherein a length of the first cleaning means is less than a width of the intermediate transfer means.

18. The transfer system according to claim 15, wherein a length of the biasing means is greater than a length of the first cleaning means.

19. The transfer system according to claim 15, wherein the second cleaning blade means is offset toward a front side of the transfer system relative to the first cleaning means.

20. The transfer system according to claim 16, wherein the second cleaning blade is offset toward a front side of the transfer system relative to the first cleaning means.

21. The transfer system according to claim 17, wherein the second cleaning blade is offset toward a front side of the transfer system relative to the first cleaning means.

22. The transfer system according to claim 18, wherein the second cleaning blade is offset toward a front side of the transfer system relative to the first cleaning means.

23. The transfer system according to claim 15, wherein the biasing means is offset toward a front side of the transfer system relative to the first and second cleaning means.

24. The transfer system according to claim 16, wherein the biasing means is offset toward a front side of the transfer system relative to the first and second cleaning means.

25. The transfer system according to claim 17, wherein the biasing means is offset toward a front side of the transfer system relative to the first and second cleaning means.

26. The transfer system according to claim 18, wherein the biasing means is offset toward a front side of the transfer system relative to the first and second cleaning means.

27. The transfer system according to claim 15, wherein a length of the first cleaning means equals a length of the second cleaning means.

28. The transfer system according to claim 15, wherein a circumferential speed of the intermediate transfer means equals a circumferential speed of the biasing means.

* * * * *